US007386260B2

(12) United States Patent
Oda et al.

(10) Patent No.: US 7,386,260 B2
(45) Date of Patent: Jun. 10, 2008

(54) LIQUID DEVELOPING UNIT AND IMAGE FORMING APPARATUS INCLUDING THE SAME

(75) Inventors: Tomoyuki Oda, Osaka (JP); Koji Murase, Osaka (JP); Hiroyuki Ueda, Osaka (JP); Hidenori Takenaka, Osaka (JP); Junpei Hobo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/599,469

(22) Filed: Nov. 15, 2006

(65) Prior Publication Data

US 2007/0122201 A1 May 31, 2007

(30) Foreign Application Priority Data

Nov. 25, 2005 (JP) ..... 2005-340590

(51) Int. Cl.
*G03G 15/10* (2006.01)

(52) U.S. Cl. ..... 399/237; 399/238; 399/239

(58) Field of Classification Search ..... 399/237, 399/238, 239

See application file for complete search history.

(56) References Cited

U.S. PATENT DOCUMENTS 3,875,581 A * 4/1975 Yamashita et al. ..... 396/607
3,916,426 A * 10/1975 Bown ..... 396/614
3,993,291 A * 11/1976 Brinkman ..... 366/83
5,329,850 A * 7/1994 Duarte ..... 101/148
5,502,552 A * 3/1996 Iwata et al. ..... 399/222
5,943,534 A * 8/1999 Watanabe ..... 399/237
6,987,941 B2 * 1/2006 Takeuchi et al. ..... 399/237
7,171,143 B2 * 1/2007 Yamasaku ..... 399/237
7,177,576 B2 * 2/2007 Kamijo et al. ..... 399/237

FOREIGN PATENT DOCUMENTS

JP 2002-278296 9/2002

* cited by examiner

*Primary Examiner*—David M. Gray
*Assistant Examiner*—Kristofferson Service
(74) *Attorney, Agent, or Firm*—Rabin & Berdo, PC

(57) ABSTRACT

Disclosed is a developing unit 6 including a tank containing a liquid toner, a pick-up roller 10 for drawing the liquid toner from the tank, an application roller 11 whose circumferential surface 11*a* is supplied with the liquid toner by the pick-up roller 10, and a developing roller 12 whose circumferential surface 12*a* is applied with the liquid toner by the application roller 11. The pick-up roller 10 and the application roller 11 are arranged in parallel to each other and circumferential surfaces 10*a*, 11*a* thereof are in contact with each other. The circumferential surfaces 10*a*, 11*a* of the pick-up roller 10 and the application roller 11 are formed with a plurality of grooves 13, 14, respectively, which extend continuously in the axial direction X1.

4 Claims, 3 Drawing Sheets

LIQUID DEVELOPING UNIT AND IMAGE FORMING APPARATUS INCLUDING THE SAME

BACKGROUND OF THE INVENTION

1. Field of the Invention

The present invention relates to an image forming apparatus including copiers, printers, facsimiles and the like, specifically, to an image forming apparatus in which development is accomplished by the liquid developing unit. Also, the present invention relates to the liquid developing unit.

2. Description of Related Art

An electrophotographic image forming apparatus includes, for example, an image forming apparatus comprising a liquid developing unit that supplies a liquid toner to a photosensitive drum on which an electrostatic latent image is formed so as to develop the electrostatic latent image. This liquid developing unit includes a developing roller for supplying the liquid toner to the photosensitive drum. The liquid toner in a tank is drawn by an application roller, and at the same time, the toner on the circumferential surface of the application roller whose amount is regulated by a doctor blade is supplied to the developing roller.

In addition, spiral-shaped grooves extending continuously in the axial direction are formed on the foregoing circumferential surface of the application roller. These grooves convey dust, paper chips and the like that enter the contact area between the application roller and the doctor blade in the axial direction to remove them (Refer to Japanese Unexamined Patent Publication No. 2002-278296, for example).

However, in the foregoing apparatus, since the liquid toner in the tank is drawn only by means of the application roller, and the drawn liquid toner needs to be leveled so that the amount thereof is even on the circumferential surface, it is disadvantageously hard to supply the developing roller with the liquid toner.

Therefore, the present inventors tried to develop an apparatus additionally provided with a pick-up roller for drawing the liquid toner from the tank in the previous stage to the application roller. However, applying the invention disclosed in the above-identified Japanese Unexamined Patent Publication to a liquid developing unit including such a pick-up roller for supplying the liquid toner to the application roller causes the following problem.

Although forming spiral-shaped grooves in the circumferential surface of the application roller makes it possible to remove foreign objects entered the contact area between the application roller and the doctor blade, in such a case, the liquid toner supplied from the pick-up roller to the application roller is conveyed in the axial direction. As a result, the liquid toner fails to be evenly supplied along the axial direction of the application roller. Accordingly, it is impossible to supply the liquid toner evenly along the axial direction of the developing roller and the photosensitive member, which results in degraded quality of the image transferred from the photosensitive member to the paper.

SUMMARY OF THE INVENTION

The present invention has been made in consideration of the foregoing background, and it is an object of the present invention to provide a liquid developing unit capable of evenly supplying a liquid toner.

It is another object of the present invention to provide an image forming apparatus in which development is accomplished by a liquid developing unit capable of evenly supplying a liquid toner.

A liquid developing unit according to the present invention comprises a pick-up roller for drawing a liquid toner from a tank, and an application roller that is in contact with a circumferential surface of the pick-up roller supplied with the liquid toner from the pick-up roller thereto by rotation in accordance with that of the pick-up roller. The circumferential surface of the pick-up roller is formed with spiral-shaped grooves for guiding the drawn liquid toner in one direction along the axial direction, and the circumferential surface of the application roller is formed with spiral-shaped grooves for guiding the liquid toner supplied from the pick-up roller in the direction opposite to the foregoing one direction.

With this structure, when the liquid toner is supplied from the pick-up roller to the application roller, the liquid toner can be prevented from being conveyed in one direction along the axial direction to be unevenly distributed on the circumferential surface of the application roller, so that the liquid toner can be supplied to the application roller evenly along the axial direction.

The foregoing pick-up roller and the application roller may rotate in directions opposite to each other, and the spiral-shaped grooves of the pick-up roller and the application roller may be twisted in the same direction. In that case, forming the spiral grooves in accordance with the rotational directions of the pick-up roller and the application roller makes it possible to prevent the liquid toner supplied from the pick-up roller to the application roller from being conveyed in the axial direction.

The foregoing pick-up roller and the application roller may rotate in the same direction and the spiral-shaped grooves of the pick-up roller and the application roller may be twisted in directions opposite to each other. In that case, forming the spiral grooves in accordance with the rotational direction of the pick-up roller and the application roller makes it possible to prevent the liquid toner supplied from the pick-up roller to the application roller from being conveyed in the axial direction.

An image forming apparatus according to the present invention can supply the liquid toner evenly along the axial direction of the developing roller and the photosensitive drum, so that the quality of the images can be improved.

DETAILED DESCRIPTION OF PREFERRED EMBODIMENTS

Figure 1:
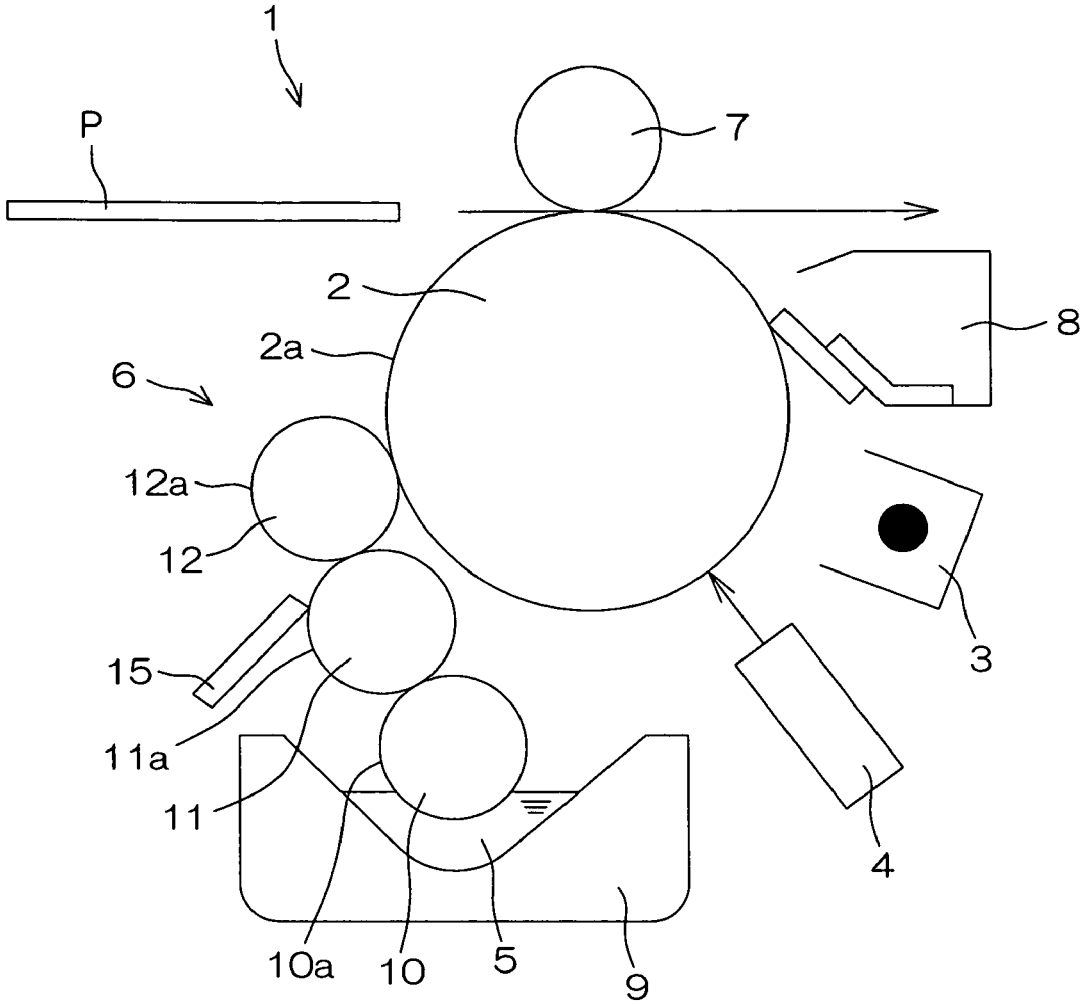
FIG. 1 is a diagram showing a schematic arrangement of an image forming section provided in a printer according to one embodiment of the present invention.

FIG. 1 is a diagram showing a schematic arrangement of an image forming section 1 provided in a printer according to one embodiment of the present invention. A nonvolatile liquid toner with high viscosity is used as a developing agent in this embodiment.

Referring to FIG. 1, the image forming section 1 includes a cylindrical photosensitive drum 2, a charging device 3 for electrically charging a circumferential surface 2*a* of the photosensitive drum 2, an exposure device 4 for forming an electrostatic latent image by irradiating an optical image based on image data onto the circumferential surface 2*a* of the photosensitive drum 2, a developing unit 6 for forming a toner image by supplying a liquid toner 5 to the circumferential surface 2*a* of the photosensitive drum 2, a transfer roller 7 for transferring the toner image formed on the circumferential surface 2*a* of the photosensitive drum 2 to a paper sheet P, and a cleaning device 8 for removing the liquid toner 5 remaining on the circumferential surface 2*a* of the photosensitive drum 2. These charging device 3, exposure device 4, developing unit 6, transfer roller 7 and cleaning device 8 are arranged so as to surround the photosensitive drum 2.

A toner image is transferred onto the paper sheet P conveyed to the image forming section 1 by the photosensitive drum 2 and the transfer roller 7. The paper sheet P with the toner image transferred thereon is heated and pressed by a fixing device that is not shown, by which the toner image is fixed on the paper sheet P.

Figure 2:
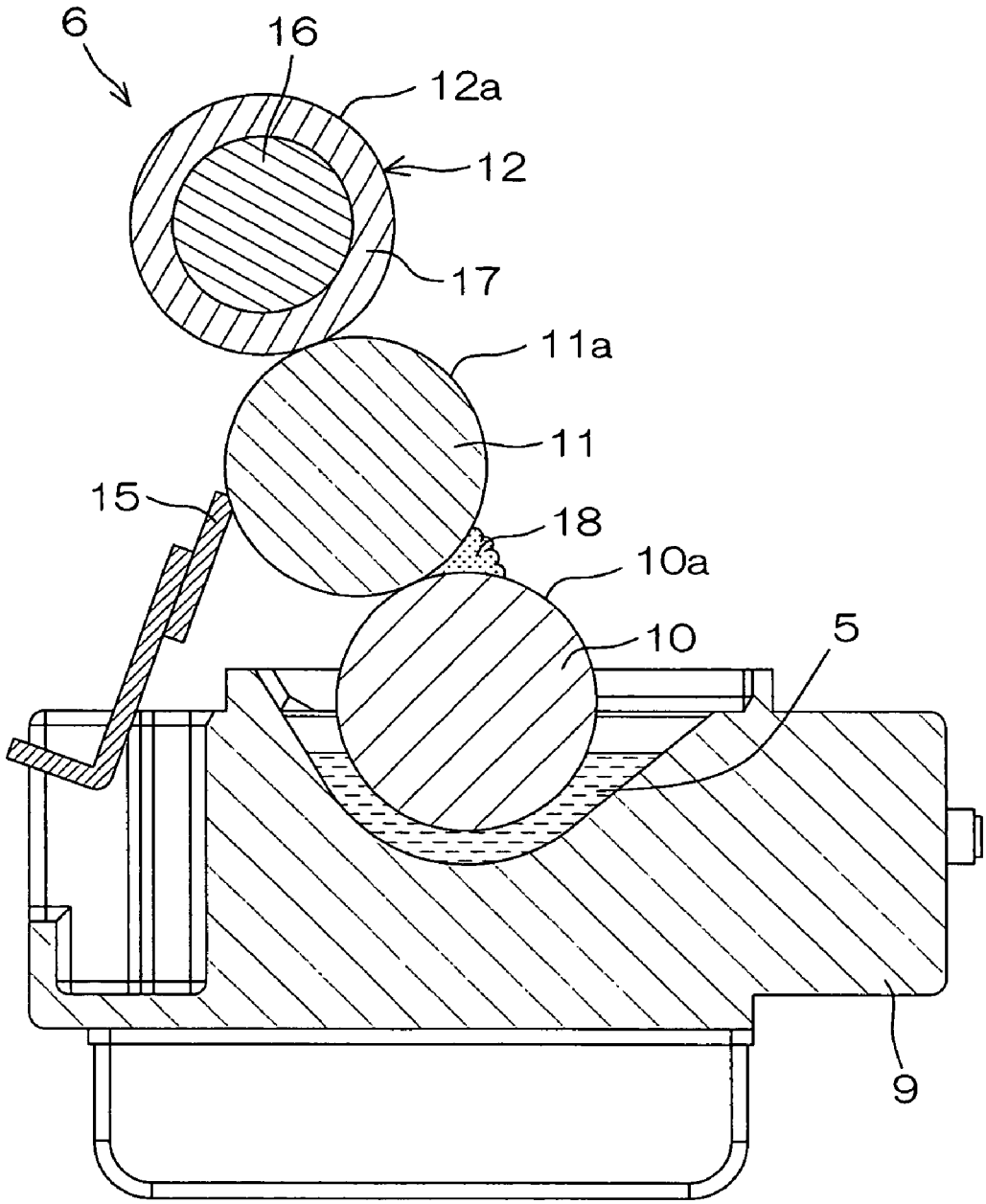
FIG. 2 is a vertical cross-sectional view of the developing unit in FIG. 1
Figure 3:
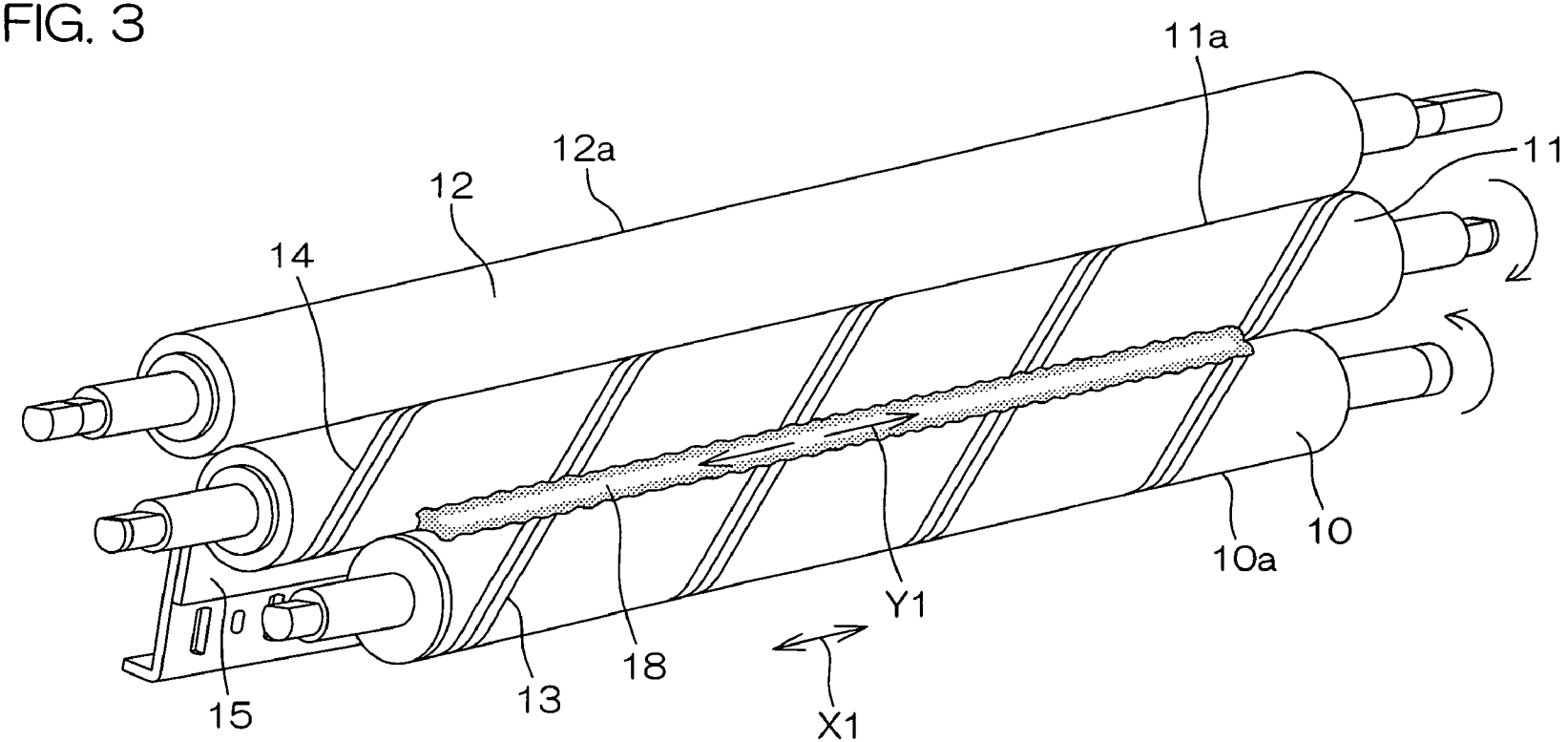
FIG. 3 is a perspective view of a part of the developing unit viewed from a direction crossing the axial direction.

FIG. 2 is a vertical cross-sectional view of the developing unit 6 in FIG. 1, and FIG. 3 is a perspective view of a part of the developing unit 6 viewed from a direction crossing the axial direction X1. Referring to FIGS. 2 and 3, the developing unit 6 includes a tank 9 containing the liquid toner 5, a pick-up roller 10 for drawing the liquid toner 5 from the tank 9, an application roller 11 whose circumferential surface 11*a* is supplied with the liquid toner 5 by the pick-up roller 10, and a developing roller 12 whose circumferential surface 12*a* is applied with the liquid toner 5 by the application roller 11.

The pick-up roller 10, application roller 11 and developing roller 12 have axis lengths that are approximately equal to the axis length of the photosensitive drum 2, and are arranged in parallel to each another. In addition, the pick-up roller 10, application roller 11 and developing roller 12 are connected to a drive source not shown so that these are each rotated independently by this drive source.

The pick-up roller 10 is made of, for example, a metal, and the circumferential surface load thereof is formed with a plurality of spiral-shaped grooves 13 extending continuously in the axial direction X1. These grooves 13 are formed to be arranged at equal intervals in the axial direction, for example, there are 180 grooves 13 per inch. In addition, the grooves 13 are regularly formed so that the cross sections thereof have predetermined shape and size.

A part of the pick-up roller 10 is inserted into the tank 9 and immersed in the liquid toner 5 within the tank 9. The liquid toner 5 in the tank 9 is drawn by the surface tension of the liquid toner and rotation of the pick-up roller 10.

The application roller 11 is made of, for example, a metal, and a predetermined voltage is applied thereto. The circumferential surface 11*a* of the application roller 11 is formed with a plurality of spiral-shaped grooves 14 extending continuously in the axial direction X1. These grooves 14 are formed to be arranged at equal intervals in the axial direction X1, for example, there are 180 grooves 14 per inch. In addition, the grooves 14 are regularly formed so that the cross sections thereof have predetermined shape and size. That is, the grooves 13 and 14 formed on the pick-up roller 10 and application roller 11, respectively, are formed to have the same shape at the same intervals.

The circumferential surface 11*a* of the application roller 11 is in contact with the circumferential surface 10*a* of the pick-up roller 10. The application roller 11 and the pick-up roller 10 are each rotated independently with the circumferential surfaces 11*a*, 11*a* thereof being in contact with each other. In the present embodiment, the application roller 11 and the pick-up roller 10 are arranged such that they are rotated in directions opposite to each other at the same speed, and the grooves 13, 14 formed on the circumferential surface 11*a* of the application roller 11 and the circumferential surface load of the pick-up roller 10 are twisted in the same direction.

In addition, a doctor blade 15 for regulating the amount of the liquid toner 5 to be supplied to the circumferential surface 11*a* of the application roller 11 is in contact with the circumferential surface 11*a* of the application roller 11. This doctor blade 15 is a plate formed of, for example, stainless steel or synthetic resin, and one side thereof is in contact with the circumferential surface 11*a* of the application roller 11 along the axial direction X1.

The developing roller 12 is applied with a predetermined voltage, and includes a core part 16 made of metal and a circumferential part 17 provided around the core part 16 that is formed of a conductive elastic material. In addition, as shown in FIG. 1, the circumferential surface 12*a* of the developing roller 12 is in contact with the circumferential surface 11*a* of the application roller 11 and the circumferential surface 2*a* of the photosensitive drum 2.

Now, how the supply of the liquid toner 5 to the respective rollers is described.

The supply of the liquid toner 5 from the pick-up roller 10 to the application roller 11 is accomplished by electrical force and surface tension of the liquid toner 5. In other words, the liquid toner 5 drawn from the tank 9 by the pick-up roller 10 is transferred circumferentially by the rotation of the pick-up roller 10 to the contact area with the application roller 11. In this contact area, a pool 18 of the liquid toner 5 is formed along the axial direction X1 by the liquid toner 5 conveyed from the pick-up roller 10. This pool 18 of the liquid toner 5 adheres to the circumferential surface 11*a* of the application roller 11 including the insides of the spiral-shaped grooves 14 along the axial direction X1 by the surface tension of the liquid toner 5 and the electrical force caused by the voltage applied to the application roller 11. By the respective rotations of the application roller 11 and pick-up roller 10, the liquid toner 5 adheres to the entire circumference of the application roller 11. In this way, the liquid toner 5 is supplied from the pick-up roller 10 to the application roller 11.

Application of the liquid toner 5 by the application roller 11 to the developing roller 12 is accomplished by electrical force and the surface tension of the liquid toner 5 in the same manner as described above. That is, the liquid toner 5 retained by the application roller 11 is applied to the circumferential surface 12*a* of the developing roller 12 at the contact area between the circumferential surfaces 11*a*, 12*a* of the application roller 11 and the developing roller 12, respectively, by electrical force and the surface tension of the liquid toner 5. By the rotations of the application roller 11 and the developing roller 12, the liquid toner 5 is applied to the entire circumference of the developing roller 12.

Here, the amount of the liquid toner 5 applied to the developing roller 12 by the application roller 11 is always kept constant. This is because the liquid toner 5 supplied from the pick-up roller 10 to the circumferential surface 11*a* of the application roller 11 is removed by the doctor blade 15 so that the liquid toner 5 remains only inside the spiral-shaped grooves 14. Therefore, a certain amount of the liquid toner 5 that corresponds to the volume of the spiral-shaped grooves 14 remains on the application roller 11. Accordingly, the amount of the liquid toner 5 applied from the application roller 11 to the developing roller 12 is also kept constant, so that a film of the liquid toner 5 with a constant thickness is evenly formed on the circumferential surface 12*a* of the developing roller 12 along the axial direction X1.

The developing roller 12 applied with the liquid toner 5 supplies the liquid toner 5 to the photosensitive drum 2. As a result, the electrostatic latent image formed on the circumferential surface 2*a* of the photosensitive drum 2 is developed.

Now, the operations of the spiral-shaped grooves 13, 14 formed on the pick-up roller 10 and the application roller 11 are described.

The spiral-shaped grooves 14 formed on the circumferential surface 11*a* of the application roller 11 are capable of conveying foreign objects including dust, paper chips and the like that enter between the application roller 11 and the doctor blade 15 in the axial direction X1. In other words, foreign objects caught between the application roller 11 and the doctor blade 15 are conveyed along the spiral-shaped grooves 14 in the axial direction X1 by the rotation of the application roller 11. This makes it possible to prevent unevenness due to entry of foreign objects from occurring in the application of the liquid toner 5 from the application roller 11 to the developing roller 12.

However, the spiral-shaped grooves 14 not only conveys foreign objects that enter between the application roller 11 and the doctor blade 15, but also apply a conveyance force in the axial direction X1 to the pool 18 of the liquid toner 5 formed in the contact area between the application roller 11 and the pick-up roller 10. When unevenness occurs in the axial direction X1 due to the conveyance of the pool 18, it becomes impossible to supply the liquid toner 5 from the pick-up roller 10 to the application roller 11 evenly along the axial direction X1.

Therefore, by the grooves 13 formed in the circumferential surface 10*a* of the pick-up roller 10, a conveyance force in the direction opposite to that applied by the grooves 14 formed in the application roller 11 is applied to the pool 18. That is, as shown in FIG. 3, by the rotation of the application roller 11, a conveyance force in one direction Y1 of the axial direction X1 is applied to the pool 18 by the grooves 14. On the other hand, by the rotation of the pick-up roller 10, an equal conveyance force in the direction opposite to the one direction Y1 is applied to the pool 18 by the grooves 13. As a result, the conveyance forces in the axial direction X1 applied to the pool 18 by the grooves 13, 14 are canceled, thereby preventing the pool 18 from being conveyed in the axial direction X1. The pick-up roller 10 can therefore supply the liquid toner 5 evenly along the axial direction X1 of the application roller 11.

As described above, according to this embodiment, forming a plurality of the spiral-shaped grooves 13, 14 on the circumferential surface 10*a* of the pick-up roller 10 and the circumferential surface 11*a* of the application roller 11 prevents the liquid toner 5 supplied from the pick-up roller 10 to the application roller 11 from being conveyed in the axial direction X1. As a result, the pick-up roller 10 can supply the liquid toner 5 to the application roller 11 evenly along the axial direction X1. Accordingly, the liquid toner 5 can be also supplied to the developing roller 12 and the photosensitive drum 2 evenly along the axial direction X1, so that the image quality of the printer can be improved.

The present invention is not limited to the foregoing description of the embodiment, but various modifications may be made within the scope of the appended claims. For example, while a case where the application roller 11 and the pick-up roller 10 rotate in directions opposite to each other at the same speed is described in the foregoing embodiment, the application roller 11 and the pick-up roller 10 may rotate in the same direction. In this case, by forming the grooves 13, 14 on the circumferential surface 11*a* of the application roller 11 and the circumferential surface 10*a* of the pick-up roller 10 so that they are twisted in directions opposite to each other, the pool 18 is prevented from being conveyed in the axial direction X1.

Moreover, while a case where the grooves 13, 14 on the circumferential surface 10*a* of the pick-up roller 10 and the circumferential surface 11*a* of the application roller 11 are formed to have the same configuration and arranged at the same intervals is described in the foregoing embodiment, the grooves 13 formed on the circumferential surface 10*a* of the pick-up roller 10 may be simplified. That is, as long as the grooves 13 formed on the pick-up roller 10 are capable of applying an equal force in the opposite direction to that applied by the grooves 14 formed on the application roller 11 to the pool 18, the number of the grooves may be reduced, or the cross section of the grooves 13 may be simplified. The cost for processing the grooves 13 can therefore be reduced.

Furthermore, while a case where the image forming apparatus is a printer is described in the foregoing embodiment, the image forming apparatus may be a copier or facsimile. In addition, the image forming apparatus may be a multifunction peripheral device having two or more functions of those of a printer, copier and facsimile.

The present invention is based on Patent Application No. 2005-340590 filed on Nov. 25, 2005 with Japanese Patent Office, the entire content of which is incorporated hereinto by reference.

What is claimed is:

1. A liquid developing unit for supplying a liquid toner, comprising:

a tank for containing a liquid toner;

a pick-up roller having a circumferential surface which draws the liquid toner from the tank to adhere the liquid toner to the circumferential surface of the pick-up roller by rotating in a first rotation direction and which has spiral-shaped grooves formed thereon which are twisted in a first direction for guiding the drawn liquid toner in one direction of the axial direction; and an application roller disposed in parallel to the pick-up roller, having a circumferential surface in contact with the circumferential surface of the pick-up roller, and supplied with the liquid toner from the pick-up roller by rotating in a second rotation direction which is opposite to the first rotation direction of the pick-up roller, the circumferential surface of the application roller having spiral-shaped grooves formed thereon which are twisted in the first direction for guiding the liquid toner supplied from the pick-up roller in a direction opposite to the one direction along the axial direction.

2. An image forming apparatus, comprising:

a tank for containing a liquid toner;

a pick-up roller having a circumferential surface which draws the liquid toner from the tank to adhere the liquid toner to the circumferential surface of the pick-up roller by rotating in a first rotation direction and which has spiral-shaped grooves formed thereon which are twisted in a first direction for guiding the drawn liquid toner in one direction of the axial direction;

an application roller disposed in parallel to the pick-up roller, having a circumferential surface in contact with the circumferential surface of the pick-up roller, and supplied with the liquid toner from the pick-up roller by rotating in a second rotation direction which is opposite to the first rotation direction of the pick-up roller, the circumferential surface of the application roller having spiral-shaped grooves formed thereon which are twisted in the first direction for guiding the liquid toner supplied from the pick-up roller in a direction opposite to the one direction along the axial direction; and a photosensitive drum disposed in parallel to the application roller to which the liquid toner adhered to the circumferential surface of the application roller is provided through a developing roller.

3. A liquid developing unit for supplying a liquid toner, comprising:

a tank for containing a liquid toner;

a pick-up roller having a circumferential surface which draws the liquid toner from the tank to adhere the liquid toner to the circumferential surface of the pick-up roller and which has spiral-shaped grooves formed thereon which are twisted in a first twisting direction for guiding the drawn liquid toner in an axial direction; and an application roller disposed in parallel to the pick-up roller and having a circumferential surface in contact with the circumferential surface of the pick-up roller, the circumferential surface of the application roller having spiral-shaped grooves formed thereon which are twisted in the first twisting direction for guiding the liquid toner supplied from the circumferential surface of the pick-up roller in an axial direction;

first driving means for rotating the pick-up roller in a first rotational direction; and second driving means for rotating the application roller in a direction opposite to the first rotational direction of the first driving means.

4. The liquid developing unit according to claim 3, wherein diameters of the pick-up roller and the application roller are the same, and the spiral-shaped surface grooves formed on the circumferential surfaces of the pick-up roller and the application roller are extended in the same direction and have the same shape, wherein the first driving means rotates the pick-up roller at a predetermined rotation speed, and wherein the second driving means rotates the application roller at the same rotation speed as that of the pick-up roller.

* * * * *